US009903571B2

(12) United States Patent
Schubert et al.

(10) Patent No.: US 9,903,571 B2
(45) Date of Patent: Feb. 27, 2018

(54) ADJUSTABLE MOUNTING TORSION SPRING RECEIVER ASSEMBLY FOR LED RETROFIT

(71) Applicant: ABL IP Holding LLC, Decatur, GA (US)

(72) Inventors: Matthew Schubert, Arlington Heights, IL (US); Joseph Stauner, Algonquin, IL (US)

(73) Assignee: ABL IP Holding LLC, Atlanta, GA (US)

( * ) Notice: Subject to any disclaimer, the term of this patent is extended or adjusted under 35 U.S.C. 154(b) by 428 days.

(21) Appl. No.: 14/824,803

(22) Filed: Aug. 12, 2015

(65) Prior Publication Data

US 2017/0045209 A1 Feb. 16, 2017

(51) Int. Cl.

| | |
|---|---|
| ***F21V 15/00*** | (2015.01) |
| ***F21V 21/14*** | (2006.01) |
| ***F21S 8/02*** | (2006.01) |
| ***F21V 21/13*** | (2006.01) |

(52) U.S. Cl.
CPC ..... *F21V 21/14* (2013.01); *F21S 8/026* (2013.01); *F21V 21/13* (2013.01)

(58) Field of Classification Search
CPC ..... F21V 21/04; F21V 17/164; F21V 17/12; F21V 17/14; F21V 21/048; F21V 21/049; F21V 21/14
USPC ..... 362/364–366
See application file for complete search history.

(56) References Cited

U.S. PATENT DOCUMENTS

| | | | | |
|---|---|---|---|---|
| 3,872,296 | A * | 3/1975 | Cohen | F21S 8/02 248/343 |
| 8,517,325 | B2 | 8/2013 | Verma et al. | |
| 8,523,409 | B1 * | 9/2013 | Drake | F21S 8/02 362/294 |
| 8,544,807 | B2 * | 10/2013 | Foreman | H04N 5/2252 248/222.11 |
| 8,545,063 | B2 * | 10/2013 | Dupuy | F21S 8/02 362/365 |
| 8,851,437 | B2 | 10/2014 | Verma et al. | |
| 9,383,087 | B2 * | 7/2016 | Rashidi Doust | F21V 21/049 |
| 2007/0019418 | A1 * | 1/2007 | Czech | F21S 8/02 362/364 |
| 2007/0217207 | A1 * | 9/2007 | Caluori | F21V 21/043 362/365 |

* cited by examiner

*Primary Examiner* — William Carter
(74) *Attorney, Agent, or Firm* — Kilpatrick Townsend & Stockton, LLP

(57) ABSTRACT

A retrofit assembly for inserting LED luminaries into previously recessed lighting fixtures has a horizontal bridge adjustable for various existing opening diameters of ceiling holes. The horizontal bridge carries two vertically adjustable brackets at its opposing ends. Tabs on the end plates of the bridge and tabs on the vertically adjustable brackets together help form bolt-operated vertical clamps adjustable for various ceiling thicknesses. The vertically adjustable brackets also carry torsion spring receivers for accepting the torsion springs of a retrofit LED luminaire/trim assembly. The vertically adjustable brackets may be spring-loaded for ease of adjustment when increasing the dimension of the vertical clamps.

9 Claims, 3 Drawing Sheets

ADJUSTABLE MOUNTING TORSION SPRING RECEIVER ASSEMBLY FOR LED RETROFIT

FIELD OF THE INVENTION

The present disclosure relates to methods and apparatus for quickly and efficiently replacing installed recessed down-lighting fixtures with solid state Light Emitting Diode (LED) fixtures/luminaires.

BACKGROUND OF THE INVENTION

There is a large installed base of recessed down-lighting fixtures. However, with the move to solid state lighting, the fixtures in the precut ceiling holes must be removed and replaced with new hardware in the old holes to accommodate the more efficient luminaires and fixtures of the LED variety.

Thus, a need exists for an improved way to quickly and efficiently replace installed recessed down-lighting fixtures with solid state Light Emitting Diode (LED) fixtures/luminaires (hereinafter "LED luminaire") in a variety of sizes of precut ceiling holes in a variety of ceiling thicknesses at the so-called 'rough-in section' and/or the ceiling hole left by the previous fixture.

While other retrofit systems have been proposed for example by U.S. Pat. No. 8,517,325, that proposed bracket has an adaptor band that needs a housing installed on the rough-in section to allow mounting of the retrofit assembly by torsion springs. Depending on the housing diameter the torsion receiver brackets of the adapter band can be less than or greater than 180° from one another. This can cause mounting difficulties for retrofit LED luminaires by causing the mounting to be off centered, which can result in non-uniform pull force through the torsion springs which need uniformity to keep the retrofit luminaire centered and flush against the ceiling. Also this adapter band must be secured with screws to the housing/frame. Depending on the fixture manufacturer this could cause excessive work as one might have to drill into the housing to properly mount the adaptor band.

Thus an easier and more economical method of retrofitting torsion spring suspended LED luminaires is desired.

SUMMARY OF THE DISCLOSED EMBODIMENTS

The present invention addresses these needs by providing a retrofit receiver assembly with adjustment in both the horizontal and vertical range, which allows universal mounting means through the separately mounted receiver assembly that clamps to the rough-in section and/or ceiling hole where existing non-LED commercial fixtures have been initially installed. This is accomplished through the adjustment of the receiver assembly in both the horizontal and vertical range to meet existing aperture diameters and ceiling thicknesses to allow easy installation of LED retrofit luminaires. The receiver assembly of the present invention clamps to the rough-in section ring or hole by its vertical adjustment, which in turn also has the torsion spring receivers built into this vertical adjustment component to allow vertical movement of the torsion receivers to keep proper pull force on the retrofit luminaire with varying ceiling thicknesses. In one example, the receiver assembly may allow LED retrofit luminaires to mount in commercially available rough-in sections with an aperture ranging from 4.88 inches to 7.30 inches with a ceiling thickness range of 0.50 inches to 1.25 inches.

In its simpler aspects the receiver assembly may be thought of as a horizontal bridge having first and second members each having a span section and an end plate perpendicular to each other, the horizontal bridge having a mechanism for setting the horizontal distance between the endplates of the first and second members to accommodate various diameters of ceiling holes; with each first and second member of the horizontal bridge carrying a vertically adjustable clamp at an end plate outside surface thereof with adjustment for various ceiling thicknesses; and each end plate having torsion spring receivers on their inside surfaces for accepting torsion springs of a luminaire assembly. The receiver assembly may comprise two "L"-shaped mating parts that fit together to complete the horizontal adjustment feature. A locking screw can be used to lock the horizontal movement after the receiver assembly is set to the desired rough-in section diameter. A third feature of the receiver assembly is a torsion spring receiver clamp that attaches to each "L"-shaped component, one torsion spring receiver per side, to allow for vertical adjustment and clamping means. This applies a clamping force between ceiling and the rough-in section or clamps to the rough-in section ring. The vertical adjustment is accomplished through a screw style design which pulls the torsion spring receiver component upward in the vertical position while turning the screw in a clockwise manner. Also, in one aspect of the present invention, a compression spring that is encapsulating the screw threads is sandwiched between each "L" shaped sheet metal component and the torsion spring receiver, which applies a downward force against the torsion spring receiver to allow for easy adjustment in the vertical position. These torsion spring receivers accept the retrofit trim luminaire mounting torsion springs at the correct distance, i.e. depth, to apply proper pull force on the retrofit luminaire so it mounts flush up against the ceiling with no sagging of the retrofit luminaire.

To operate the receiver assembly one must first remove any housing, reflector/trim, and remove or disconnect any power supply affiliated with the non-LED fixture. Once completed there should be the fixtures rough-in section ring, junction box, and mounting flanges left. At this point one must take the receiver assembly and place it up into the rough-in section through the ceiling opening, i.e. hole. Then the receiver assembly must be opened/expanded to the desired diameter in the rough-in section ring so the "L"-shaped components can sit level on top of the ring. To accomplish this one must pull one side of the receiver assembly and hold the opposite side against the rough-in section ring opening edge. Once expanded to the desired diameter for the fixture, the receiver assembly should be sitting on top of the rough-in section with the tab sections of the vertical clamps hanging below the ceiling. The locking screw can now be tightened to lock the horizontal distance. Finally the torsion spring receiver screw can be tightened (turned clockwise) to apply a clamping force at the ceiling and/or rough-in section ring.

According to some aspects of the invention an exemplary retrofit assembly is provided for inserting LED luminaries into the locations of previously installed recessed lighting fixtures, the receiver assembly comprising a horizontal bridge having first and second members each having a span section and an end plate perpendicular to each other, the first member having a hole in its span for accepting a horizontal locking screw and the second member having a slot in its span for accepting the horizontal locking screw, whereby the distance between the endplates of horizontal bridge members is adjustable. Each of the endplates then further has an extension tab extending perpendicular from an outside surface of the endplate at a lower end thereof Each first and second member of the horizontal bridge carries a vertically adjustable bracket at its end plate. The vertically adjustable brackets have bottom tabs at their outside surfaces whereby the end plate tab and the bottom tab of the vertically adjustable bracket together form a vertical clamp with adjustment for various ceiling thicknesses. A screw extending between the vertically adjustable bracket and the span is included to set the vertical adjustment, and the vertically adjustable brackets having torsion spring receivers on their inside surfaces for accepting torsion springs of a retrofit LED luminaire/trim assembly. In other aspects of the present invention, the boss with a throughhole can be part of the torsion spring receivers, and in still other aspects the retrofit assembly may further include the vertically adjustable brackets being spring-loaded for ease of adjustment when increasing the dimension of the ceiling thickness clamp.

BRIEF DESCRIPTION OF THE DRAWINGS

The foregoing and other advantages of the disclosed embodiments will become apparent upon reading the following detailed description and upon reference to the exemplary drawings according to one or more embodiments disclosed herein, wherein.

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1:
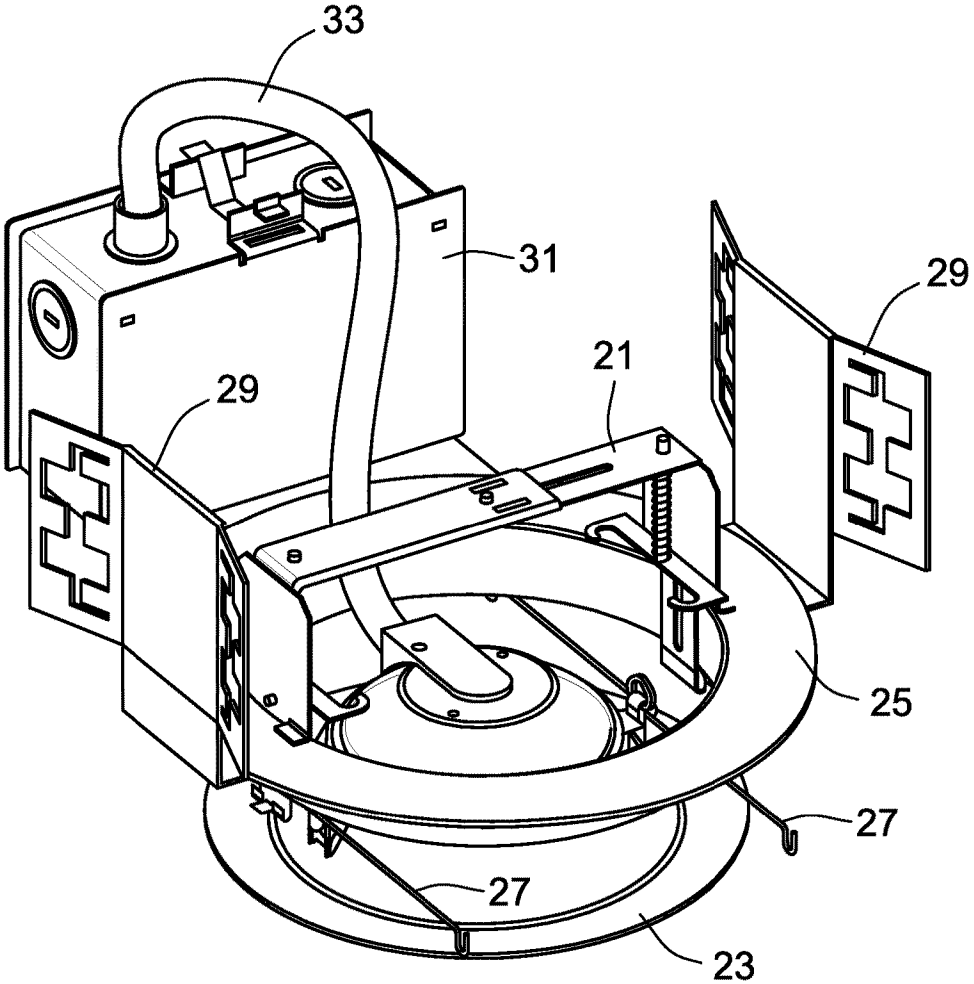
FIG. 1 shows a top front perspective view of an exemplary retrofit receiver assembly situated in the rough-in frame of a previously installed recessed light, with the preexisting hanger frame, junction box and electrical connection for the recessed light shown, according to one or more embodiments disclosed herein.

In FIG. 1, a retrofit Torsion Spring Receiver Assembly 21 is shown with a modern retrofit LED luminaire 23 beneath it. The ceiling panel is not shown for ease of illustration but will be understood by those in the art to be in a position surrounding an exemplary rough-in section ring 25. To anchor the LED luminaire 23 within the existing ceiling hole, the illustrated receiver assembly 21 will attach to parts of a previously installed recessed lighting fixture, namely the rough-in section ring 25. The receiver assembly 21 may then accept the torsion springs 27 mounted 180 degrees apart on the top side of the LED luminaire 23. As further detailed below, the torsion spring receivers 79 (FIG. 3) on this receiver assembly 21 will always be 180° apart from one another to allow an even pull force from torsion springs and torsion spring receivers. This also helps to keep the retrofit luminaire 23 centered when installed. The receiver assembly 21 is anchored to the rough-in section ring 25 which, as understood by those in the art, will have been tied to ceiling joists (not shown) by mounting parts 29. The previous electrical junction box 31 for the recessed down light may also be reused for the retrofit luminaire. A new electrical conductor connection 33 is preferably provided during the retrofit. It will be noted that the bottom tabs of the receiver assembly 21 of the present invention may be used without a rough-in trim ring 25 if such is not available, and can be clamped to an edge of the previously cut hole in the ceiling panel.

Figure 2:
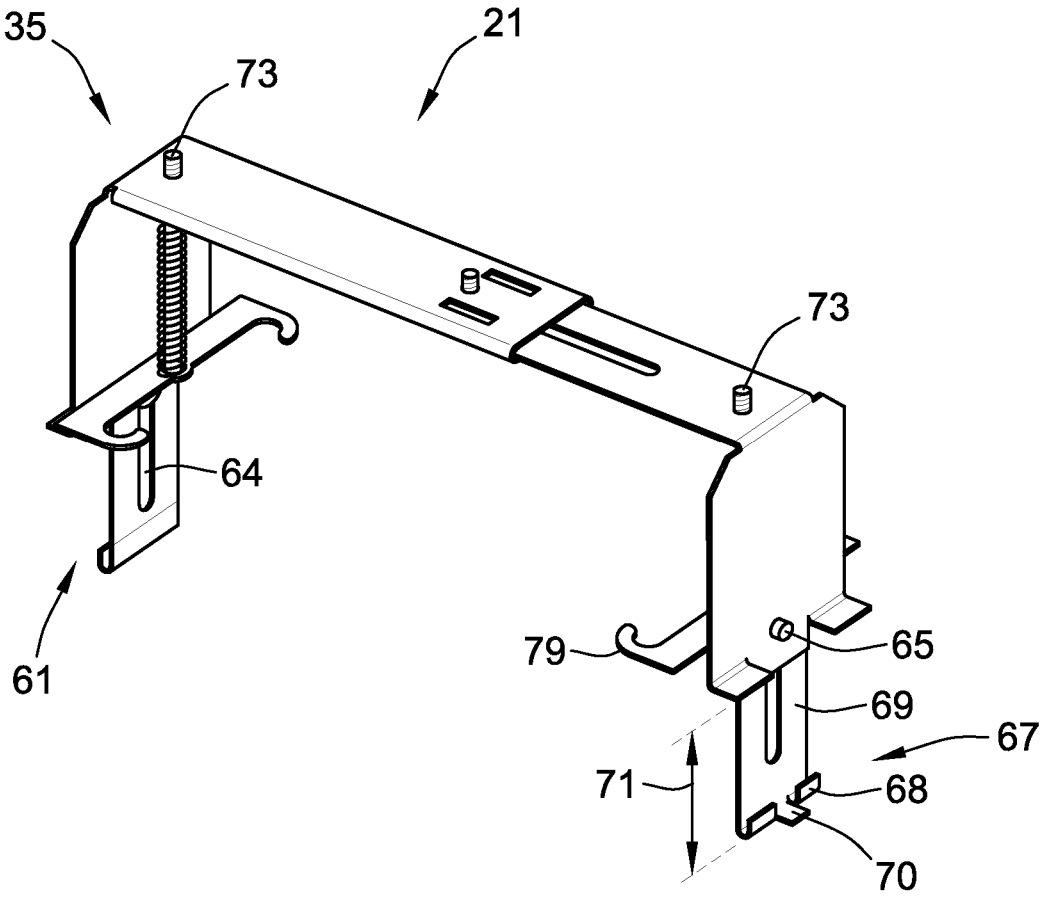
FIG. 2 shows a perspective view of an assembled exemplary retrofit receiver assembly.
Figure 3:
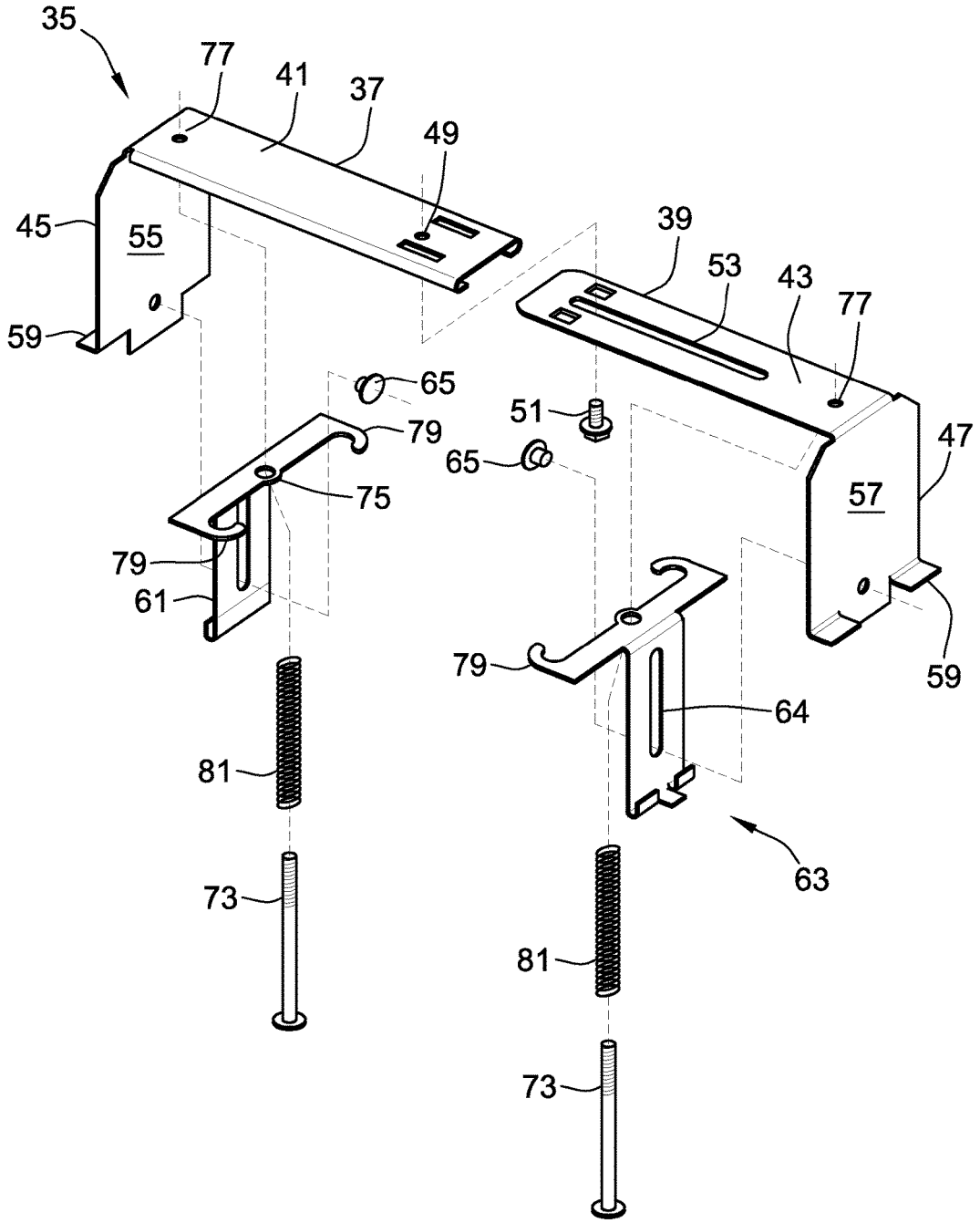
FIG. 3 shows an exploded view of the parts of the exemplary retrofit receiver.

Referring also to FIGS. 2 and 3, after the installer has removed any housing and reflector/trim affiliated with the old non-LED fixture, the receiver assembly 21 is placed up into the rough-in section through the hole in the ceiling/rough-in section ring 25. Then it must be opened/expanded to the desired diameter in the rough-in section ring so the "L" shaped components can sit level on top of the ring. To accomplish this the installer will pull one side of the receiver assembly 21 and hold the opposite side against the rough in frame ring opening edge. Once expanded to the desired diameter for the fixture, the receiver assembly 21 should be sitting on top of the rough-in section ring 25 with the vertically adjustable bracket tabs 67 hanging below the ceiling. The horizontal locking screw 51 can then be tightened to lock the horizontal distance. Finally the torsion spring receiver screw 73 can be tightened to apply a clamping force on the ceiling panel and/or rough-in section ring 25.

The exemplary receiver assembly 21 comprises: a horizontal bridge 35 having first and second members 37, 39 respectively, which are shown in a preferred form as female and male parts which are slidably interleaved (FIG. 2) for horizontal adjustment and secure positioning. Each member has a span section 41, 43 respectively, and an end plate section 45, 47 respectively, which are perpendicular to each other. The first member 37 has a hole 49 in its span 41 for accepting a horizontal locking screw 51 and the second member 39 having a slot 53 in its span 43 for accepting the horizontal locking screw 51, whereby the distance between the endplates 45, 47 of the horizontal bridge members 37, 39 is adjustably set.

Each of the endplates 45, 47 has an inside surface 55 and outside surface 57 and further has one or more extension tabs 59 extending perpendicular from the outside surface 57 of the endplates 45, 47 preferably at the lower, free, end thereof Each of the first member 37 and second member 39 of the horizontal bridge 35 carries a vertically adjustable bracket 61, 63 respectively, at the lower end of its end plate by a slidably riveted connection between the end plate and a slot, collectively 64, in the vertically adjustable bracket, preferably via a vertical guide rivet 65. The vertically adjustable brackets 61, 63 have a set of bottom tabs 67 at their outside surfaces 69 including at least one tab 68 bent upwardly to surround the bottom lip of the rough-in section ring 25, and one tab 70 extending perpendicularly outward for cases where there is only a ceiling opening and no rough-in section ring 25. Thus, the end plate tab 59 and at least one of the vertically adjustable bracket bottom tabs 67 will together form a vertical clamp 71 with adjustment for various ceiling thicknesses, it being understood that "ceiling thickness" in this sense will include "rough-in section frame ring thickness" if that piece is present at installation.

A vertical adjustment screw 73 extends between a throughhole in a boss 75 on the vertically adjustable bracket 61, 63 to a threaded throughhole, 77 on each of the respective spans 41, 43 to set the vertical adjustment which controls the depth of the vertical clamp 71. The vertically adjustable brackets 61, 63 also carry torsion spring receivers 79 on their inside surfaces 55, the torsion spring receivers 79 being C-shaped brackets for accepting the arms of the torsion springs 27 (FIG. 1) of the retrofit LED luminaire assembly 23. In the exemplary aspect of the present invention, the boss 75 and its throughhole can be part of the torsion spring receivers 79. In still other aspects the retrofit torsion spring receiver assembly 21 may further include the vertically adjustable brackets 61, 63 each being spring-loaded by a helical compression spring, collectively 81, to bias the vertically adjustable brackets downward for ease of adjustment when increasing the dimension of the ceiling thickness clamp 71.

In certain aspects of the present invention, the main parts of the torsion spring receivers assembly 21 may be formed of sheet metal and allow for horizontal adjustments to fit varying rough-in section apertures ranging from 4.88 inches to 7.30 inches. Vertical adjustment may allow for ceiling thicknesses ranging from 0.50 inches to 1.25 inches while allowing for proper pull force between the torsion springs and their torsion spring receivers by having a consistent distance between the torsion spring receivers and the luminaires' torsion springs. There is no drilling required with this example assembly as it clamps to the previously existing rough-in section frame and/or the ceiling. The retrofit torsion spring receiver assembly 21 also does not require any previous or further fixture housing attached to the rough-in section ring for use as mounting means, because it carries its own torsion spring receivers 79.

Alternative design elements such as replacing the screw style adjustment of the vertical clamp 71 to apply the same clamping force in a different mechanical action might be realized. The aperture diameters and ceiling thickness ranges which the assembly accepts could be easily altered. Torsion spring receiver styles for the luminaire might be altered to different mounting springs or clip styles.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the scope of the disclosed embodiments as defined in the appended claims.

What is claimed is:

1. An adjustable mounting torsion spring receiver assembly for inserting retrofit luminaries into previously used spaces for recessed lighting fixtures, comprising:

a) a horizontal bridge having first and second members each having a span section and an end plate perpendicular to each other, the first member having a hole in its span for accepting a horizontal locking screw and the second member having a slot in its span for accepting the horizontal locking screw, whereby a clamping force between the first and second members can be applied and the distance between the endplates of the first and second members is set by use of the horizontal locking screw to accommodate various diameters of ceiling holes;

b) each of the endplates further having an extension tab extending perpendicular from an outside surface of the endplate, c) each first and second member of the horizontal bridge carrying a vertically adjustable bracket at its end plate, i) the vertically adjustable brackets having bottom tabs at their outside surfaces, whereby the end plate extension tab and a bottom tab of the vertically adjustable bracket together form a vertical clamp with adjustment for various ceiling thicknesses, ii) a screw extending between the vertically adjustable bracket and the span to adjust the vertical clamp, and iii) the vertically adjustable brackets having torsion spring receivers on their inside surfaces for accepting torsion springs of a luminaire assembly.

2. The adjustable mounting torsion spring receiver assembly of claim 1 wherein the first member has a female span and the second member has a male span.

3. The adjustable mounting torsion spring receiver assembly of claim 1 wherein the first and second members are L-shaped.

4. The adjustable mounting torsion spring receiver assembly of claim 1 wherein each first and second member of the horizontal bridge is carrying the vertically adjustable bracket at its end plate by a slidably riveted connection between the end plate and a slot in the vertically adjustable bracket.

5. The adjustable mounting torsion spring receiver assembly of claim 1 further including a screw extending between a throughhole in a boss on the vertically adjustable bracket to a threaded throughhole on the respective spans to set the adjustment of the vertical clamp.

6. The adjustable mounting torsion spring receiver assembly of claim 1 wherein the boss is part of the torsion spring receivers.

7. The adjustable mounting torsion spring receiver assembly of claim 1 wherein the torsion spring receivers are C-shaped clips.

8. The adjustable mounting torsion spring receiver assembly of claim 1 wherein the luminaire is a retrofit LED luminaire assembly.

9. The retrofit mount of claim 1 further including the vertically adjustable brackets being spring-loaded for ease of adjustment when increasing the dimension of the ceiling thickness clamp.

* * * * *